US009181716B1

(12) United States Patent
Gibson

(10) Patent No.: US 9,181,716 B1
(45) Date of Patent: Nov. 10, 2015

(54) SYSTEM FOR MOUNTING ELONGATED PANELS TO A SUBSTRUCTURE

(71) Applicant: Brent Alan Gibson, Grants Pass, OR (US)

(72) Inventor: Brent Alan Gibson, Grants Pass, OR (US)

( * ) Notice: Subject to any disclaimer, the term of this patent is extended or adjusted under 35 U.S.C. 154(b) by 0 days.

(21) Appl. No.: 14/330,682

(22) Filed: Jul. 14, 2014

Related U.S. Application Data

(60) Provisional application No. 61/846,957, filed on Jul. 16, 2013.

(51) Int. Cl.

| | |
|---|---|
| ***E04F 11/16*** | (2006.01) |
| ***E04F 15/02*** | (2006.01) |
| ***E04B 1/38*** | (2006.01) |
| ***E04D 12/00*** | (2006.01) |
| ***E04B 5/12*** | (2006.01) |
| ***E04F 15/04*** | (2006.01) |

(52) U.S. Cl.
CPC ..... *E04F 15/02044* (2013.01); *E04B 1/38* (2013.01); *E04B 5/12* (2013.01); *E04D 12/006* (2013.01); *E04F 15/02038* (2013.01); *E04F 15/04* (2013.01)

(58) Field of Classification Search
CPC ..... E04B 5/12; E04B 1/38; E04B 1/2608; E04F 15/04; E04F 2201/0517; E04F 15/02183; E04F 15/02044; E04F 15/02038; E04D 12/006
USPC ..... 52/177, 480, 489.1, 489.2, 512, 586.2
See application file for complete search history.

(56) References Cited

U.S. PATENT DOCUMENTS

| | | | | |
|---|---|---|---|---|
| 3,020,602 | A * | 2/1962 | Siering | 52/714 |
| 3,208,119 | A * | 9/1965 | Seckerson | 52/716.6 |
| 3,267,630 | A * | 8/1966 | Omholt | 52/506.1 |
| 4,848,049 | A * | 7/1989 | Hanson | 52/97 |
| 4,907,387 | A * | 3/1990 | Turnbull | 52/177 |
| 5,148,644 | A * | 9/1992 | Weir | 52/300 |
| 5,727,354 | A * | 3/1998 | Clement | 52/387 |
| 5,772,185 | A * | 6/1998 | Pulsipher | 256/59 |
| 6,374,558 | B1 * | 4/2002 | Surowiecki | 52/241 |
| 6,446,409 | B1 * | 9/2002 | Emerson | 52/712 |
| 6,449,911 | B1 * | 9/2002 | Hudson | 52/58 |
| 6,598,362 | B2 * | 7/2003 | Hikai | 52/235 |
| 6,865,858 | B1 * | 3/2005 | Pollard | 52/716.2 |
| 7,398,623 | B2 * | 7/2008 | Martel et al. | 52/489.2 |
| 7,805,902 | B2 * | 10/2010 | Martel | 52/489.1 |
| 8,146,303 | B2 * | 4/2012 | Gibson et al. | 52/177 |
| 8,544,229 | B2 * | 10/2013 | Kilgore et al. | 52/489.2 |
| 8,656,671 | B1 * | 2/2014 | Chambers | 52/302.1 |
| 2004/0045244 | A1 * | 3/2004 | Hafner | 52/489.1 |
| 2005/0252154 | A1 * | 11/2005 | Martel et al. | 52/712 |
| 2011/0099928 | A1 * | 5/2011 | Klein et al. | 52/232 |
| 2013/0019549 | A1 * | 1/2013 | Henriquez | 52/220.2 |
| 2013/0031856 | A1 * | 2/2013 | Pilz et al. | 52/232 |

* cited by examiner

*Primary Examiner* — Basil Katcheves
*Assistant Examiner* — Joshua Ihezie

(57) ABSTRACT

The system for mounting elongated panels to a substructure is a steel track having a series of formed connectors for receiving and engaging decking planks. The system for mounting elongated panels to a substructure will allow a deck system to be installed without the use of any mechanical fasteners such as screws, nails or individual fasteners, and will allow installation of deck systems mounted onto wood, concrete, or steel substructures, in a horizontal, vertical, overhead (or anything in between) fashion. The upper fasteners and receivers, referred to as tangs, maintain the desired gap between composite deck boards for the life of the deck.

12 Claims, 10 Drawing Sheets

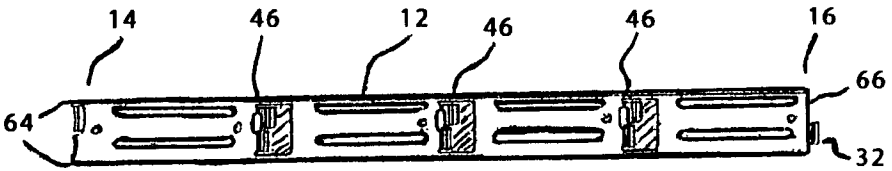
FIG. 2A
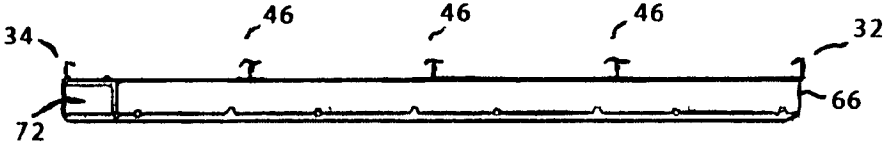
FIG. 2B
FIGURE 2

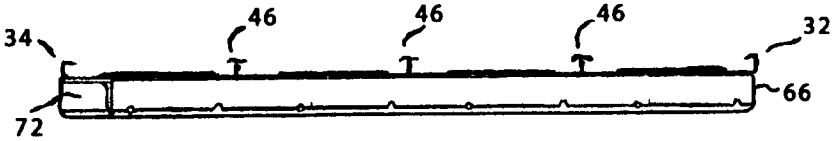
FIG. 2C
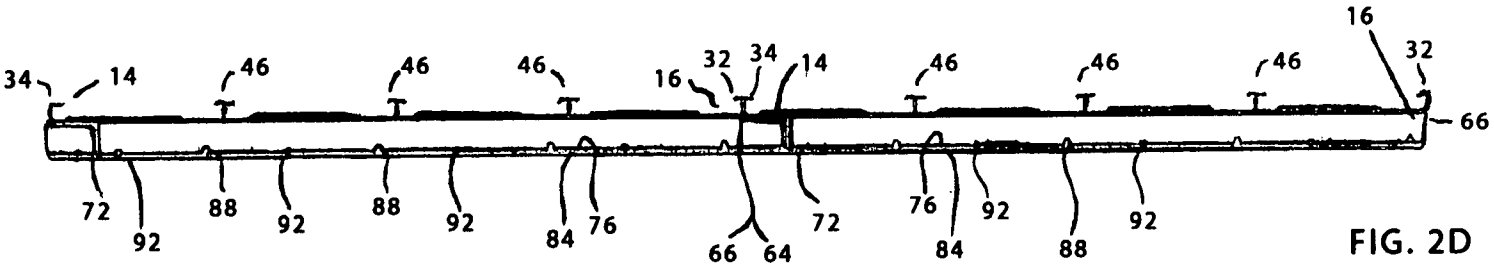
FIG. 2D
FIGURE 2 Cont.

FIG. 7B
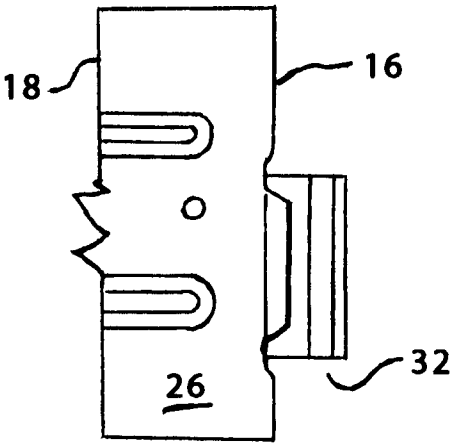
FIG. 7A
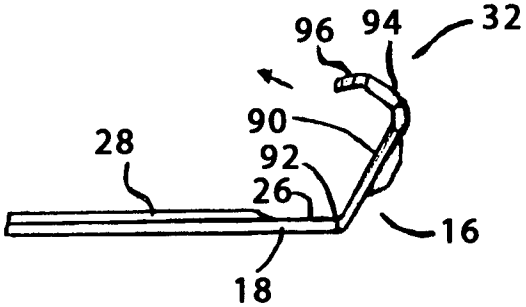
FIGURE 7

SYSTEM FOR MOUNTING ELONGATED PANELS TO A SUBSTRUCTURE

CROSS-REFERENCE TO RELATED APPLICATIONS

The present application claims priority benefit, with regard to all common subject matter, of earlier filed U.S. provisional patent application titled "SYSTEM FOR MOUNTING ELONGATED PANELS TO A SUBSTRUCTURE" application No. 61/846,957, filed Jul. 16, 2013. The earlier filed provisional patent application is hereby incorporated into the present application by specific reference.

BACKGROUND

The use of manufactured composite wood and plastic planking for decks, ceilings and wall coverings is becoming more and more common. Such planks frequently are manufactured with slots formed into the lateral sides to receive clamps, to obviate the need to drill through the plank for installation, which would expose the plank interior to water and rotting.

The planking requires a supporting substructure to install to, such as floor or ceiling joists, or wall studs or stringers. Conventional installation methods require a large number of clips to be fastened to the substructure individually. This conventional method is time consuming, difficult to ensure quality control, and not very strong or reliable—especially in high-wind weather—because the clips are not interconnected to be mutually supporting.

Composite planks are also less combustible, thus they are being used more frequently for construction of deck surrounds on structures in wildfire-prone areas. This often includes the use of steel or aluminum girder substructures, which creates a fireproof or fire resistant barrier around the structure.

The inventor previously developed an improved system using a strip of mounting clips mountable to a floor joist, which is described in U.S. Pat. No. 8,146,303 (issued Apr. 3, 2012) but that system was not a complete solution. The clips are subject to distortion during installation, and the receiver-side tangs do not securely engage the plank slot sidewalls or back walls. Thus, although the planking is able to accept deadweight in an exterior flooring use, the planks are vulnerable to lifting in hurricane situations, and the system is not reliable for installations on vertical walls or ceilings. Also, the prior system does not provide for easy integration with steel or aluminum girder substructures. Furthermore, the prior system requires a specialized tool to engage the fastening tangs.

Thus, there is a need for a system to engage planks to a substructure which provides improved installation efficiency, improved performance in extreme weather, reliable installation on vertical and ceiling surfaces, greater compatibility with metal girder substructures, and does not require a proprietary tool.

SUMMARY AND ADVANTAGES

The system of the present invention presents numerous advantages, including: (1) more reliable engagement of panels to the substructure; (2) less likely for connectors to bend or warp when installing; (3) less likely for connectors to bend or break due to temperature fluctuations that cause the expansion or contraction of the deck panels and/or substructure; (4) provides for installation using standard flooring hammer and tools; (5) provides for installation using standard hammer; (6) provides ability to use with steel girder substructures; (7) provides ability to use on vertical surfaces; (8) provides ability to hang from overhead substructure, as a suspended ceiling surface; (9) provides for less expensive manufacturing process; (10) provides for much faster, less labor intensive, and more accurate on-site installation; (11) provides ability to use laser alignment tools to align base portions on substructure; and (12) provides ability to mount to a concrete substructure.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

FIG. 1A shows a partial top plan view of a first embodiment.

FIG. 1B shows an end view of a first embodiment, from the leading edge.

FIG. 2 shows several additional views of a first embodiment.

FIG. 2A shows a top plan view of a first embodiment,

FIG. 2B shows a side view of a first embodiment, with intermediate panel connectors inclined at an angle.

FIG. 2C shows a side view of a first embodiment, with intermediate panel connectors at a vertical angle.

FIG. 2D shows a side view of a first embodiment showing two elongated members oriented end-to-end.

FIG. 7 shows two close up partial views of a second embodiment.

FIG. 7A shows a close up view of a trailing edge panel connector of a second embodiment.

FIG. 7B shows another close up view of a trailing edge panel connector of a second embodiment.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In the description, terms of orientation are used, for example "top" and "bottom", "upper" and "lower" are for reference only. In this context, "bottom" or "lower" & etc., refers to portions proximate the substructure to which the apparatus is to be mounted, while "top" and "upper," etc., refers to portions distal from the substructure. In cases where the apparatus is mounted to a vertical substructure, or underhung from a ceiling substructure, the "top" portion may actually be facing horizontally outward, or downward towards the ground or floor. Similarly, "forward", "front" and similar terms refer to the direction toward the "leading edge", while "aft", "rearward" and similar terms refer to the direction toward the "trailing edge".

Figure 1:
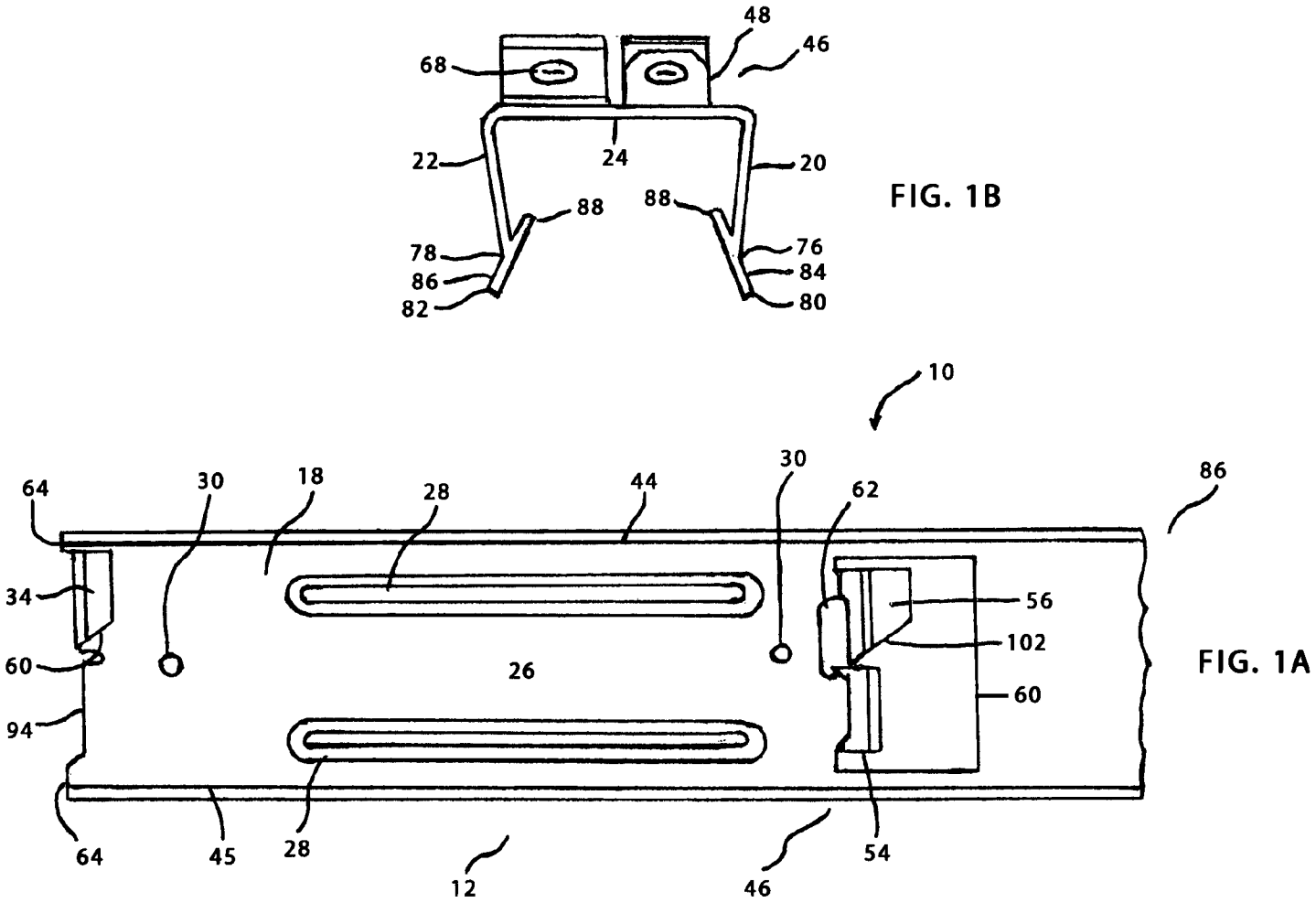
FIG. 1 shows several views of a first embodiment.
Figures 1, 1C:
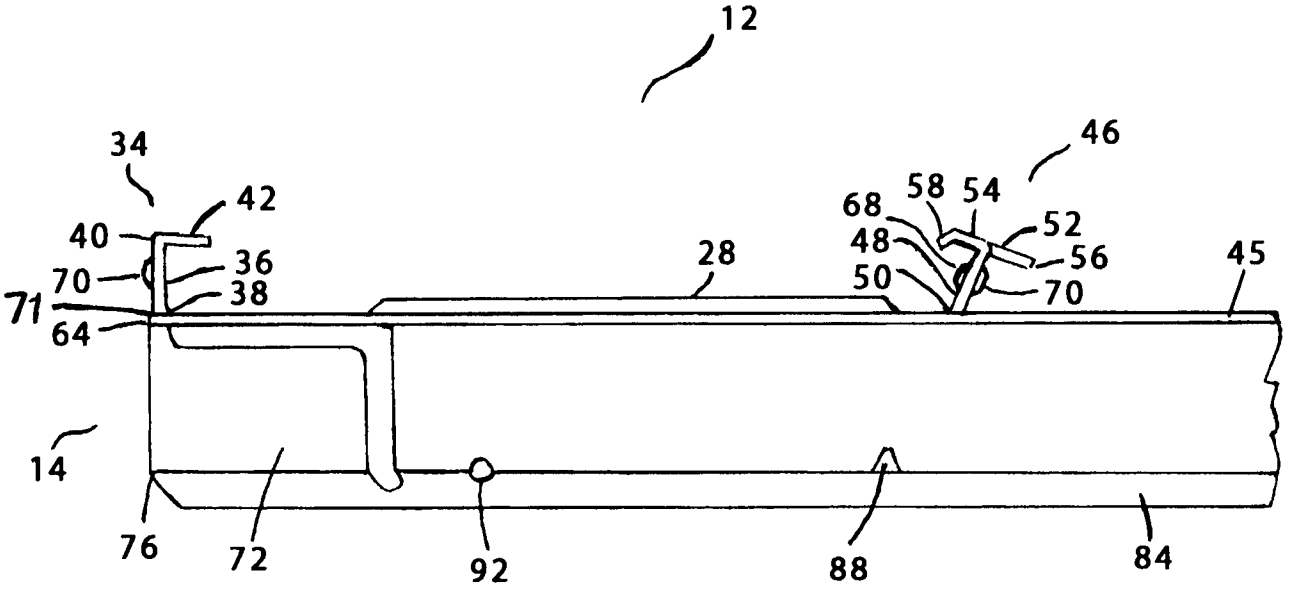
FIG. 1C shows a partial side view of a first embodiment.
Figure 3:
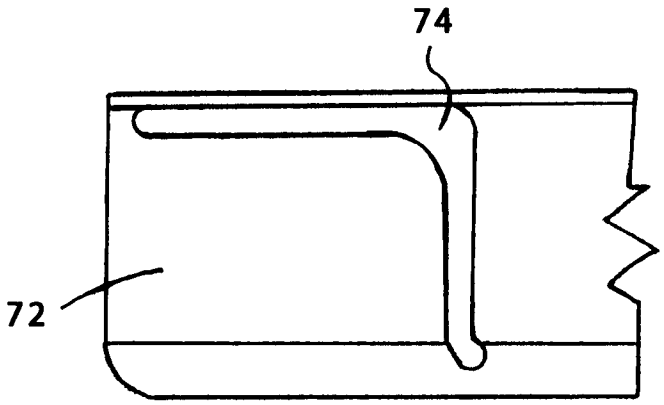
FIG. 3 shows a close up view of a breakaway cutout of a first embodiment.
Figure 4:
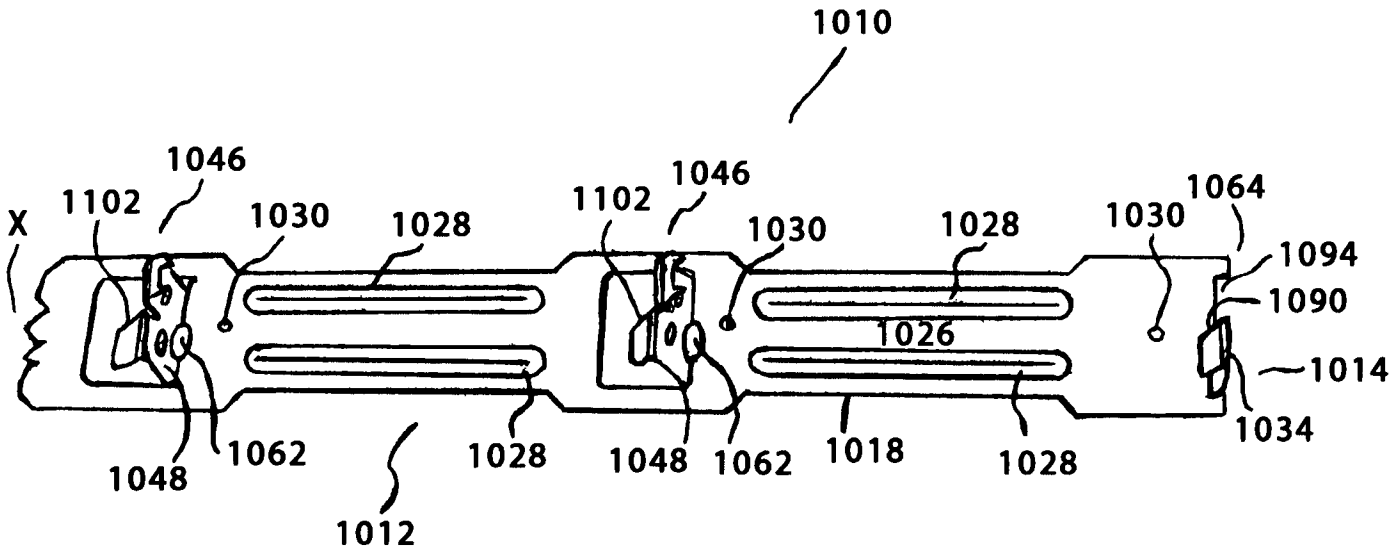
FIG. 4 shows a perspective top view of a portion of an elongated member of a second embodiment, cut off at location X.
Figure 5:
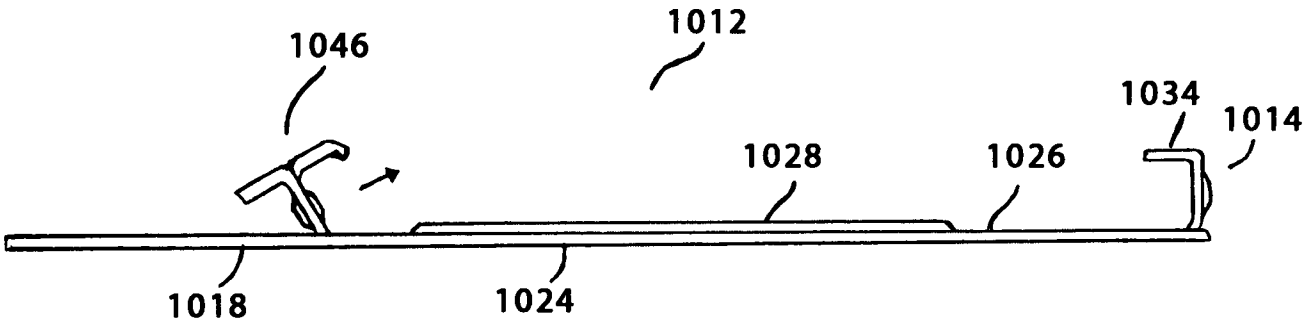
FIG. 5 shows a partial side view of a portion of a second embodiment with a leading edge connector.
Figure 6:
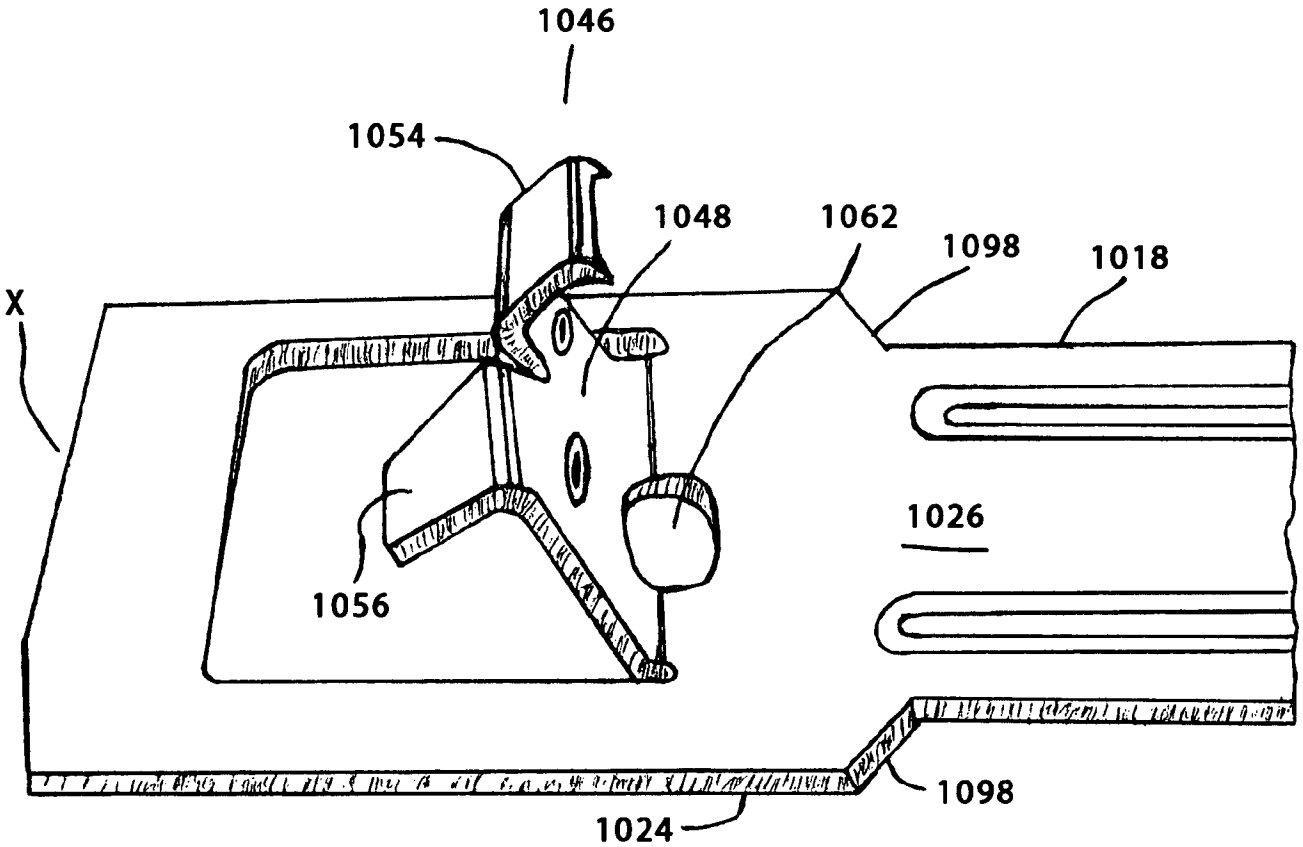
FIG. 6 shows a close up view of an intermediate panel connector of a second embodiment.
Figure 8:
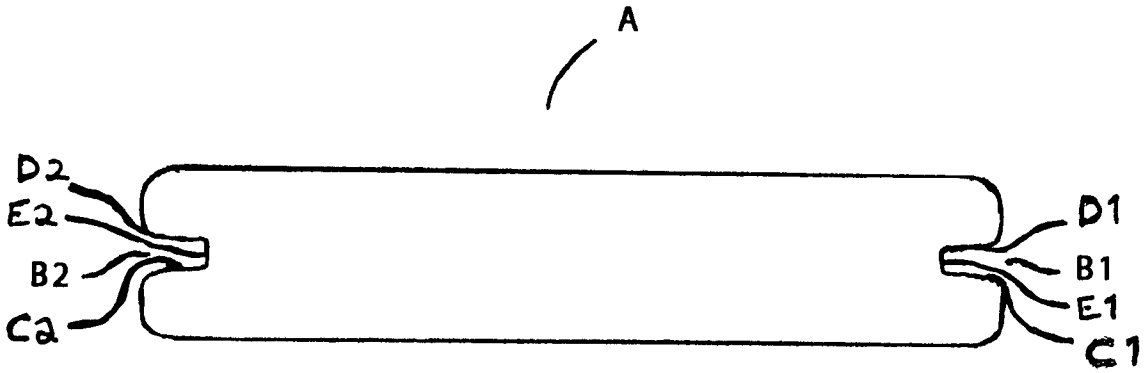
FIG. 8 shows a cutaway cross-section view of a common type of composite plank or panel. The term "capped" refers to the fact that the exterior sealing membrane completely encloses the panel, including being formed into the interiors of the side channels.

Additionally, reference is made to "plank", "panel" and similar terms. In this regard, a "plank" is simply a type of elongated "panel", and, referring to FIG. 8 showing a cutaway end view of a plank or panel A, the terms are used interchangeably to refer to longitudinally elongated members having lateral side channels or grooves B1, B2, to allow installation without drilling or nailing through the panel, As shown in FIGS. 1-3, a first embodiment of the system 10 is shown. The first embodiment is optimized for mounting to a substructure comprising wood or composite joists, studs or stringers. In the first embodiment, the system 10 includes an elongated base member 12 extending from a leading edge 14 to a trailing edge 16. Elongated base member 12 is formed into a generally u-shaped channel having a top plate 18 and opposed first and second sidewalls 20 & 22, respectively, extending downward from the top plate 18 at top plate opposed right and left edges 44, 45, respectively. Top plate 18 width extends from first sidewall 20 to second sidewall 22, and has a bottom surface 24 and a top surface 26. Top plate 18 includes a plurality of top spacers 28 extending upwards from the top plate top surface 26. The top spacers 28 accommodate variations in plank thicknesses, impart upward pressure on planks so that the first engagement tangs 54 and second receiving tangs 56 will engage the planks more securely and provide an air space for water drainage, helping to prevent rot.

In the embodiment, a penetration 30 is adapted to receive a fastener, for example a nail, wood screw, beveled screw or rivet, or self-tapping screw, or to be used to receive a spot weld.

A leading edge panel connector 34 is disposed proximate the base leading edge 14 and projecting upward from the top plate 18, the leading edge panel connector 34 comprising a connector base plate 36 extending from a bottom portion 38 coupled to the top plate 18 to an upper portion 40, and a receiving tang 42 projecting from the connector base plate upper portion 40 toward the elongated base trailing edge 16. Leading edge panel connector bottom portion contains stiffening beads 71 formed by indentations in the folded area, which provide stability and support to the connector. Leading edge panel connector engagement tang 42 extends transversely from proximate the top plate right edge 44 to a point equal or less than the longitudinal center of the top plate (to accommodate the trailing edge panel connector 32).

The trailing edge panel connector 32 is disposed proximate the base trailing edge 16 and projecting upward from the top plate 18 at an approximate 60-degree angle, the trailing edge connector 32 comprising a connector base plate 90 extending from a bottom portion 92 coupled to the top plate 18 to an upper portion 94, and an engagement tang 96 projecting from the connector base plate upper portion 94 toward the elongated base toward the elongated base leading edge 14.

The system 10 includes a plurality of intermediate panel connectors 46 disposed along the length of the top plate 18 and projecting upward from top plate 18. Each intermediate panel connector 46 comprises a connector base plate 48 extending from a bottom portion 50 coupled to the top plate to an upper portion 52, a first engagement tang 54 projecting from the connector base plate upper portion 52 toward the elongated base leading edge 14, and a second receiver tang 56 projecting from the connector base plate upper portion 52 toward the elongated base trailing edge 16.

In the first embodiment, each intermediate panel connector base plate 48 extends from top plate 18 at an angle inclined toward the base portion trailing edge 16. This permits easy installation of a plank into the adjacent connector 46, then forcing the next inclined panel connector 46 upward to force engagement tang 54 into the side channel B1, B2 of a prefabricated plank A, In the first embodiment, each intermediate panel connector base plate 48 angle is approximately 60 degrees.

In the first embodiment, each intermediate panel connector first engagement tang 54 includes a downward folded lip 58 proximate the free end, which may fold when the intermediate panel connector 46 is hammered into a plank side channel B1, B2, providing a flat compression surface against the channel interior back wall E1, E2 and downward facing teeth to more tightly engage the side channel lower interior sidewall C1, C2 or D1, D2. In the embodiment, the second receiving tang 56 is not bent and does not contain any teeth, to facilitate insertion of the next plank. Each intermediate panel connector second receiver tang includes an approximate 45-degree angled cut 102 to allow clearance for hammering and engagement of the intermediate connectors.

In the first embodiment, intermediate panel connectors 46 are formed into the top plate 18 by cutting or punching the intermediate panel connector outline 60 into the top plate 18, folding the intermediate panel connector 46 upward and folding the first and second engagement tangs 54, 56, respectively, forward and aft. In the first embodiment, a connector base plate oval penetration 62 is provided in the panel connector base plate 48 disposed along the forward edge of the fold line where the connector base plate 48 bends upward from the top plate 18. The oval penetration 62 allows for proper engagement of the intermediate connector by providing stress relief and facilitates engagement without cracking at the fold line.

In the first embodiment, each intermediate connector base plate 48 includes leading and trailing spacers 68, 70, respectfully, projecting outward to ensure proper spacing between adjacent panel members. In the embodiment, the combined thickness of the leading and trailing edge spacers 68, 70 is 3/16 inch to ensure adequate drainage, air flow, and to accommodate manufacturing tolerances and shrinkage and swelling.

The elongated base member leading and trailing edges 14, 16, each include an aligning edge 64 & 66, respectively, to facilitate laying the apparatus in series (as shown in FIG. 2D), wherein the trailing edge aligning edge 66 of one base member abuts the leading edge alignment edge 64 of the next following elongated base member 12. The leading edge 14 contains a recessed portion disposed to accommodate the trailing edge 16 and corresponding trailing edge panel connector 32, to further facilitate laying the apparatus in a series.

Referring to FIG. 3, in the first embodiment, each elongated base member first and second sidewalls 20, 22, includes a breakaway cutout 72 proximate the leading edge aligning edge 64, Each breakaway cutout 72, when removed, provides a right-angled notch to allow the elongated base member 12 to fit firmly up against and over a header board or blocking. In the embodiment, the breakaway cutout 72 is formed by partially cutting a 90-degree notch 74, and can be easily removed at the installation site as needed, using conventional metal snippets or folding back and forth to break the remaining material. The breakaway cutout 72 may be left intact if not needed to fit against a header or blocking, providing additional strength, thereby preventing the top plate 18 from buckling or lifting over time.

In the first embodiment, each of elongated base member first and second sidewalls 20, 22 are angled inward toward each other from proximate the top plate 18 (where they connect to form the "shoulder" of the U-shaped cross section) to a respective longitudinal fold line 76, 78 proximate to but set back from their open edges 80, 82, respectively, to create first and second sidewall outwardly flared extensions 84, 86, respectively. A plurality of inwardly oriented teeth 88, with apex oriented upwards, are formed into each sidewall 20, 22, disposed along the length of the respective fold lines 76, 78. The inward angle of the sidewalls 20, 22, inwardly oriented teeth 88 provide tight engagement over a substructure member, such as a joist, and prevent lifting or shifting during installation, without using special tools and without having to immediately insert fasteners, thereby ensuring proper alignment is maintained until securely fastened. In many cases, no further fasteners will be required to securely anchor the elongated base member to the substructure.

Referring to FIGS. 4-7, a second embodiment of a system 10 is shown, adapted for installation on a wood or metal girder substructure. The second embodiment comprises an elongated base member 12 which includes a flat top plate 18 to go against the members of a substructure, such as one or more wood or metal girders, the top plate 18 including a top surface 26. Top plate including intermediate top plate edge recesses 98, identical on each side of the top plate, providing for lighter weight design.

Leading edge panel connector 34 proximate leading edge alignment edge 64 includes a receiving tang oriented aft, and intermediate panel connectors 46 with receiving and engagement tangs 54, 56, projecting from base plate 48 are provided. A plurality of top spacers 28 are provided, distributed on the upper surface 26 of the top plate 18.

The system 10 described in the second embodiment may be integrated into prefabricated metal girders as well, In another embodiment, not shown, the elongated base member 12 of the second embodiment may be pre-mounted to a metal girder using precision alignment techniques in a manufacturing plant by spot welding, riveting, or otherwise permanently coupling the top plate 18 to a girder upper surface, thereby obviating the need to align and mount the system 10 in the field.

The panel connectors 46 and 1046 of the described embodiments may be oriented at an angle relative to the longitudinal axis of the elongated base member 12, 1012, in order to provide installation of planks in a pattern having a different alignment than the substructure. In this way, the panels may be aligned in the most aesthetically pleasing orientation, or multiple orientations, for the design of the overall structure without compromising the structural integrity of the supporting substructure and plank connections, or requiring complicated or expensive alterations to the substructure. As an example, the panel connectors 46, 1046, may be rotated to a 45-degree angle relative to the elongated base member 12, 1012, to provide diagonal alignment of planks, or a chevron pattern, if desired.

Alternatively, as shown with the second embodiment, the elongated base members may be mounted across the substructure members at a perpendicular or an oblique angle, to install the planking at any desired orientation.

As can be seen, the system may also be used with conventional wood planking having side channels routed into the lateral sides.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

The embodiments of the invention in which an exclusive property or privilege is claimed are defined as follows:

1. A fastening track for securing laterally adjacent, slotted or grooved decking planks, a first embodiment of said fastening track comprising: an elongated base member extending from a leading edge to a trailing edge, wherein said base member is formed into a generally u-shaped channel having a top plate and opposed first and second side panels, extending downward from said top plate to opposed right and left edges, respectively, said top plate having a width extending from said first side panel to said second side panel and having a bottom surface and a top surface; a breakaway cutout in said first and second side panels formed by partially cut 90-degree notch cuts, wherein said 90-degree notch cuts extend to an area just short of both the leading edge as well as the first and second side panel bottom edges of the elongated base member; a recessed portion in said leading edge disposed to accommodate the trailing edge and corresponding trailing edge panel connector; a plurality of top spacers extending upward from said top plate top surface; a plurality of intermediate panel connectors disposed along the length of said top plate and projecting upward from said top plate, said intermediate panel connectors comprising a connector base plate extending from a bottom portion coupled to said top plate to an upper portion, a first engagement tang projecting from a connector base plate upper portion toward the elongated base leading edge, and a second receiver tang projecting from a connector base plate upper portion toward the elongated base trailing edge; a leading edge panel connector disposed proximate the base leading edge and projecting upward from said top plate comprising a connector base plate extending from a bottom portion coupled to said top plate to an upper portion, a receiving tang projecting from a connector base plate upper portion toward the elongated base trailing edge; a trailing edge panel connector disposed proximate said base trailing edge and projecting upward from said top plate comprising a connector base plate extending from a bottom portion coupled to said top plate to an upper portion, an engagement tang projecting from a connector base plate upper portion toward said elongated base leading edge; a plurality of penetrations situated between all said leading, intermediate and trailing connectors.

2. The fastening track as set forth in claim 1, wherein said side panels of said track supply a compression contact fit with supporting planks via an inward, acute-angle bend of said side panels.

3. The fastening track as set forth in claim 1, wherein said side panels of said track include a longitudinal fold line proximate to but set back from their open edges, to create respective first and second sidewall outwardly flared extensions.

4. The fastening track as set forth in claim 2, wherein said side panels of said track include a plurality of inwardly oriented teeth with apex oriented upwards, formed into each sidewall disposed along the length of the respective fold lines.

5. The fastening track set forth in claim 1, wherein said intermediate panel connector include a connector base oval penetration disposed along the forward edge of a fold line where said connector base plate bends upward from said top plate.

6. The fastening track set forth in claim 1, wherein said leading edge panel connector is disposed proximate said base leading edge and projecting upward from said top plate at an approximate 90-degree angle.

7. The fastening track set forth in claim 6, wherein said leading edge panel connector bottom portion contains stiffening beads formed by indentations.

8. The fastening track set forth in claim 1, wherein the intermediate panel connector second receiver tang includes an approximate 45-degree angled cutout on the left side of said receiver tang.

9. The fastening track set forth in claim 1, wherein said trailing edge panel connector is disposed proximate said base trailing edge and projecting upward from said top plate at an angle away from said leading edge.

10. The fastening track set forth in claim 1, wherein said engagement tangs include a downward folded lip and downward facing teeth.

11. The fastening track set forth in claim 1, wherein said intermediate panel connector base plate extends from top plate at an angle inclined toward said base portion trailing edge.

12. The fastening track set forth in claim 1, wherein said leading, trailing, and intermediate connector base plates include leading and trailing spacers projecting outward, said spacers having a combined thickness of approximately 3/16 inches.

* * * * *